United States Patent [19]

Pasquine

[11] 4,428,580

[45] Jan. 31, 1984

[54] VARIABLE DICE GAME DEVICE

[76] Inventor: Anthony Pasquine, 1750 Lucretia Dr., Girard, Ohio 44420

[21] Appl. No.: 416,886

[22] Filed: Sep. 13, 1982

[51] Int. Cl.[3] ..... A63F 9/04

[52] U.S. Cl. ..... 273/145 C

[58] Field of Search ..... 273/145, 146

[56] References Cited

U.S. PATENT DOCUMENTS

| | | | |
|---|---|---|---|
| 954,070 | 4/1910 | Zschau | 273/145 C |
| 2,269,742 | 1/1942 | Smith | 273/145 R |
| 2,639,153 | 5/1953 | Murray | 273/145 C |
| 2,739,815 | 3/1956 | Fay | 273/145 C |
| 3,508,755 | 4/1970 | Johnson | 273/145 C |

FOREIGN PATENT DOCUMENTS

| | | | |
|---|---|---|---|
| 114899 | 5/1929 | Austria | 273/146 |
| 2451761 | 11/1980 | France | 273/146 |
| 480550 | 2/1938 | United Kingdom | 273/145 C |

*Primary Examiner*—Paul E. Shapiro

*Attorney, Agent, or Firm*—Harpman & Harpman

[57] ABSTRACT

A variable dice game device which is particularly useful as a random number generator comprises a closed hollow transparent body member of generally rectangular shape and having three transparent partitions therein dividing the interior into four rectangular compartments with a ten-sided die freely movable in each of said compartments.

6 Claims, 4 Drawing Figures

VARIABLE DICE GAME DEVICE

BACKGROUND OF THE INVENTION

1. Technical Field

This invention relates to dice game devices in which dice or the like game pieces are freely positioned in individual compartments in a common hollow body member so as to provide a random number generator when the game device is agitated to reposition the game pieces.

2. Description of the Prior Art

Prior devices of this type are best illustrated in U.S. Pat. Nos. 2,526,123 and 2,739,815. These patents disclose game devices with game pieces in individual compartments.

U.S. Pat. No. 1,613,575 discloses a similar game device in which small balls are confined in a hollow structure with cavities in the appropriate surface of the structure for temporarily positioning the balls adjacent desirable indicia.

U.S. Pat. Nos. 809,293 and 4,239,226 disclose game pieces having multiple surfaces.

The present invention differs from the prior art primarily in providing a game device which may be used in the popular Pick Three or Pick Four numbers games similar to the many state lottery games based on the same Pick Three or Pick Four games.

SUMMARY OF THE INVENTION

A transparent substantially rectangular hollow body member has spaced transverse partitions dividing the interior into four hollow compartments. A rectangular light impervious panel is positioned on the upper surface of the rectangular body adjacent one end thereof to completely cover the rectangular hollow compartment therebelow. All of the remaining top, bottom, sides and ends of the device are completely transparent and a ten-sided die with the numbers 1 through 0 on its ten sides is freely positioned in each of the four compartments which are substantially larger in cross section than the area of the ten-sided die. Agitating the device with the light impervious panel on the uppermost surface and placing it on a relatively flat support produces three random numbers useful in a pick three number game while turning the device over and agitating it and placing it on a substantially flat surface produces four random numbers useful in a pick four numbers game.

DESCRIPTION OF THE PREFERRED EMBODIMENT

Figure 1:
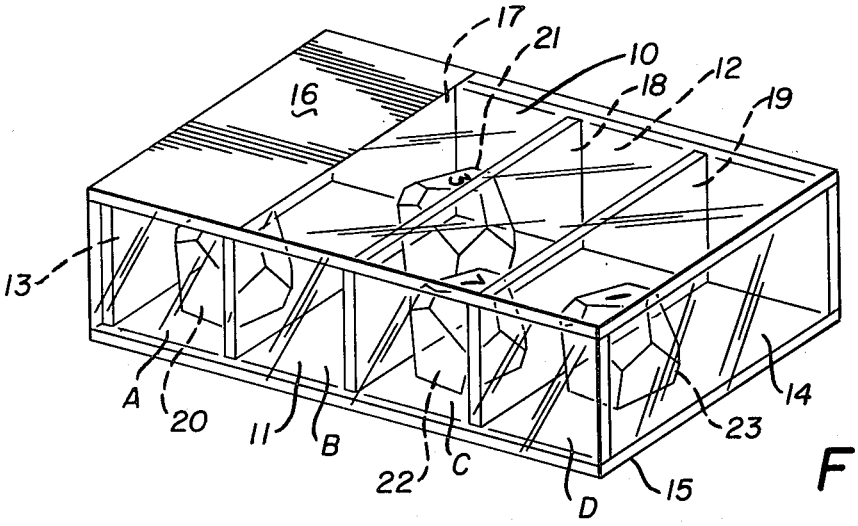
FIG. 1 is a perspective elevation of the variable game device showing the top, one side and one end thereof.

By referring to the drawings and FIG. 1 in particular, it will be seen that a variable dice game device has been shown which comprises a substantially rectangular hollow body member formed of transparent material such as PLEXIGLASS or the like. A top portion 10 is supported on two vertically standing side portions 11 and 12 and two vertically standing end portions 13 and

14. These in turn are positioned on a bottom portion 15. The top portion 10 has a rectangular light impervious panel 16 covering one-quarter of the top portion 10, the left end portion thereof as seen in FIG. 1 of the drawings. The light impervious panel 16 may be used to carry suitable game instructions or other indicia as desired.

Figure 4:
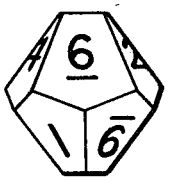
FIG. 4 is an enlarged plan view of one of the ten-sided dice used in the game device.

Still referring to FIG. 1 of the drawings, it will be seen that there are three transversely positioned partitions 17, 18 and 19 equally spaced longitudinally of the device and forming equally sized cross sectionally square elongated hollow compartments, A,B,C and D. A ten-sided die having one of the numbers 1 through 0 on each of its ten sides is positioned in each of the compartments, A,B,C and D and indicated by the reference numerals 20, 21, 22, and 23 respectively. A perspective view of one of the ten-sided dice may be seen in enlarged detail in FIG. 4 of the drawings.

Referring again to FIG. 1 of the drawings, it will be observed that when the variable dice game is viewed from the top, through the top portion 10, the three ten-sided dice, 21, 22, and 23 will be visible and that a number will be displayed on the uppermost flat surface of each of the ten-sided dice so that the three numbers thus displayed comprise a three digit number which is the result of the random number generation performed by the game device.

Figure 2:
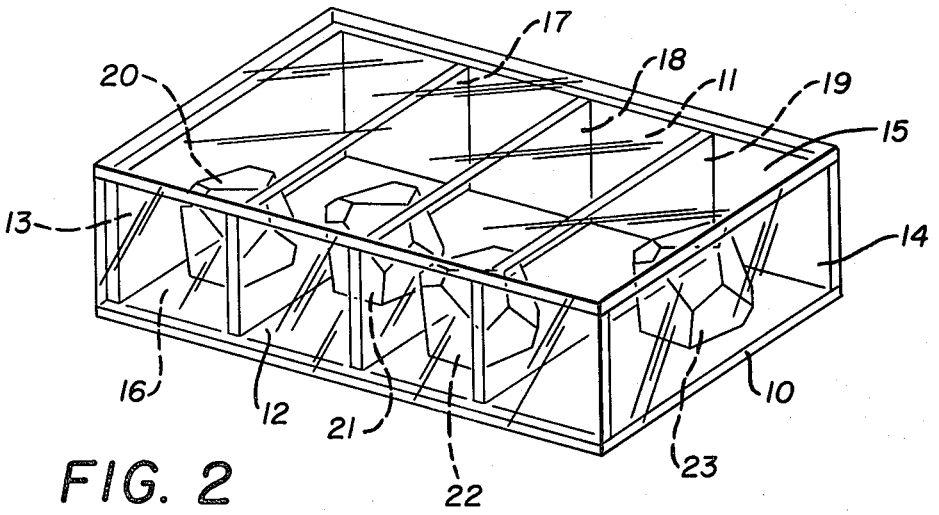
FIG. 2 is a perspective elevation of the variable game device showing the bottom, the other side and the other end thereof.

In FIG. 1 of the drawings, the numbers 3,7 and 1 are illustrated on the upper flat surface of the dice 21, 22 and 23 respectively, thus forming the three digit number 371. When the device is to be used to randomly generate a four digit number, it is turned over from the position shown in FIG. 1 of the drawings to the position shown in FIG. 3 of the drawings where the light impervious panel 16 is now on the bottom of the device. Agitation of the device and placing it in the position shown in FIG. 2 on a substantially flat surface will produce a four digit number by random generation when the numbers on the flat upper surfaces of each of the dice 20, 21, 22 and 23 are grouped.

Figure 3:
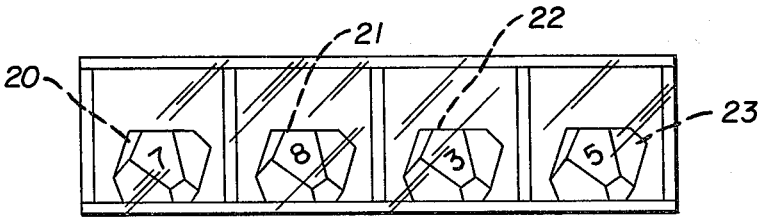
FIG. 3 is a side elevation of the device.

In FIG. 3 of the drawings, a side elevation of the variable dice game device is illustrated to demonstrate the relatively large area of each of the compartments A,B,C and D as compared with the overall size of each of the dice.

It will be understood that the markings on the faces of the dice are not limited to numerals. They may alternately comprise representations of various figures, letters, or the like, as desired.

It will be understood that the dice game device may be made of any suitable transparent material including the PLEXIGLASS hereinbefore mentioned and it will also be understood that the shape of the device may be varied from that shown so long as there are a plurality of elongated chambers therein in which the dice can move longitudinally as well as in a tumbling motion which is desirable in insuring a completely random number generation.

Although but one embodiment of the present invention has been illustrated and described, it will be apparent to those skilled in the art that various changes and modifications may be made therein without departing from the spirit of the invention and having thus described my invention what I claim is:

1. A variable dice game device comprising a substantially rectangular closed hollow transparent housing defined by top and bottom portions, oppositely disposed sides and oppositely disposed ends spacing said top and bottom portions and a plurality of transverse intersecting partitions arranged in equally spaced relation to one another and said ends and forming four elongated cross sectionally square hollow compartments, a light impervious panel affixed to said top portion in registry with one of said hollow compartments and a game piece comprising a ten-sided die freely positioned in each of said four hollow compartments, indicia on each of the ten-sides of each of said dies whereby three of said dies may be viewed through the top portion of said device and four of said dies may be viewed through the bottom portion of said device.

2. The variable dice game device of claim 1 and wherein said hollow compartments are at least three times as long as their width and their height is equal to their width.

3. The variable dice game device set forth in claim 1 and wherein the indicia on each of the ten sides of each of said dies comprise the numerals 1 through 0.

4. The variable dice game device of claim 1 and wherein the overall height of each of said dices substantially equal to one half the height of each of said hollow compartments.

5. The variable dice game device of claim 1 and wherein the width of each of said dice is substantially one-half the width of each of said compartments.

6. The variable dice game device of claim 1 and wherein the length of each of the four hollow compartments is at least five times the largest dimension of each of said dice.

* * * * *